US009849470B1

(12) United States Patent
Yattara et al.

(10) Patent No.: US 9,849,470 B1
(45) Date of Patent: Dec. 26, 2017

(54) VARIABLE SIZE HOLE MULTI-HOLE NOZZLE AND COMPONENTS THEREOF

(71) Applicant: The Procter & Gamble Company, Cincinnati, OH (US)

(72) Inventors: Naby Laye Moussa Yattara, Schaerbeek (BE); Justin Thomas Cacciatore, Cincinnati, OH (US); John Marshall Allen, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/175,341

(22) Filed: Jun. 7, 2016

(51) Int. Cl.

| | |
|---|---|
| ***B67C 3/26*** | (2006.01) |
| ***B05B 1/14*** | (2006.01) |
| *B65B 39/12* | (2006.01) |
| *B05B 1/30* | (2006.01) |

(52) U.S. Cl.
CPC ..... *B05B 1/14* (2013.01); *B67C 3/26* (2013.01); *B05B 1/30* (2013.01); *B65B 39/12* (2013.01)

(58) Field of Classification Search
CPC .... B67C 3/26; B67C 3/00; B67C 3/32; F15D 1/04; B65B 39/12; B65B 3/04; B05B 1/30; B05B 1/14; B08B 9/00
USPC ..... 141/94, 180, 286, 311; 222/504, 559, 222/565, 485; 137/244; 239/570, 565
See application file for complete search history.

(56) References Cited

U.S. PATENT DOCUMENTS

| | | | | |
|---|---|---|---|---|
| 1,250,222 | A | 12/1917 | Rahner | |
| 2,352,359 | A | 3/1943 | Anderson | |
| 4,512,379 | A * | 4/1985 | Hennig | B65B 3/22 141/286 |
| 4,730,786 | A | 3/1988 | Nelson | |
| 5,094,278 | A * | 3/1992 | Arao | B65B 39/00 141/116 |
| 5,954,086 | A * | 9/1999 | Ronchi | B65B 39/004 137/244 |
| 6,161,780 | A | 12/2000 | Sugimoto et al. | |
| 7,000,656 | B2 * | 2/2006 | Todd | B65B 3/30 141/1 |
| 7,594,616 | B2 * | 9/2009 | Hupp | F16K 23/00 141/311 A |

(Continued)

FOREIGN PATENT DOCUMENTS

| | | |
|---|---|---|
| EP | 0 278 560 A1 | 8/1988 |
| FR | 2 905 121 B1 | 9/2010 |

*Primary Examiner* — Paul R Durand
*Assistant Examiner* — Andrew P Bainbridge
(74) *Attorney, Agent, or Firm* — Lauren Christine Gonzalez; Gary J. Foose

(57) ABSTRACT

A multi-hole nozzle component having a periphery, an inlet side and an opposing outlet side. The nozzle component having a plurality of first passageways having a plurality of first openings each first opening having a first opening area, a plurality of second passageways having a plurality of second openings each second opening having a second opening area, and a plurality of third passageways having a plurality third openings each third opening having a third opening area. The plurality of second openings are arranged about the plurality of first openings. The plurality of third openings are arranged about the plurality of first openings. The second opening area is greater than the first opening area and the second opening area is about equal to the third opening area.

17 Claims, 7 Drawing Sheets

(56) References Cited

U.S. PATENT DOCUMENTS

| | | | | |
|---|---|---|---|---|
| 7,958,910 | B2 * | 6/2011 | Nakamori ..... | B65B 39/00<br>138/37 |
| 2014/0077006 | A1 | 3/2014 | Goudy | |

* cited by examiner

VARIABLE SIZE HOLE MULTI-HOLE NOZZLE AND COMPONENTS THEREOF

FIELD OF THE INVENTION

A variable size hole multi-hole nozzle and components thereof for a filling machine.

BACKGROUND OF THE INVENTION

Liquid products, particularly household and fabric care compositions such as dishwashing soap, hand soap, and surface cleansers, are a popular choice among consumers. Generally such liquids are sold within plastic containers. These plastic containers oftentimes have a body with a larger bottom end and an opposing tapered neck connecting to a smaller top end. The larger bottom end allows for a container to stand upright on a surface such as for storage purposes. The smaller top end can be attached to a cap or to a dispenser for dispensing purposes. The smaller top end is oftentimes a round opening. This opening is usually relatively small in area to make it easier for a consumer to control the amount of liquid that poured out of the container. During the manufacturing process of the container holding the liquid, manufacturers will use a container filling system to dispense liquids through the opening into the container.

High-speed container filling systems are well known and used in many different industries. In many of the systems, the containers are filled through a series of pumps, pressurized tanks and flow meters and/or valves to help ensure that the correct amount of liquid is dispensed into the containers. These pumps, pressurized tanks, flow meters, and/or valves are typically connected to a nozzle having an opening above or within the container opening. The liquid flows through this nozzle opening into the container. Manufacturers are continually looking for ways to increase the volumetric flow rate of the liquid during the filling process, which in turn increases the speed and efficiency of the process of filling containers with liquids.

Filling containers through small top openings can be challenging to do quickly due to size constraints of the top opening and the neck coupled with the rheological properties of the liquid. To compensate for slower filling speeds associated with conventional size, single orifice nozzles, the nozzle orifice size can be made larger, allowing higher volumetric flow rates and faster filling cycles. However, when filling containers, especially at high volumetric flow rates, the large opening can create a surge of liquid at the end of the filling event that can cause the liquid in the container to splash in a direction generally opposite to the direction of filling and often out of the container being filled. This is especially true for lower viscosity liquids such as hard surface cleaners, examples of which are under the tradenames MR. CLEAN, SWIFFER WETJET, and VIAKAL manufactured by The Procter & Gamble Company. Higher viscosity liquids, such as dishwasher liquids, such as, for example, those sold under the tradename DAWN and laundry detergents such as, for example, those sold under the tradenames TIDE and GAIN manufactured by The Procter & Gamble Company may result in a filament or string that forms and hangs down from the filling nozzle at the end of the filling event, this filament or string taking some time to break up after flow to the nozzle ceases.

Alternatively, a nozzle can have a multitude of smaller openings through which liquid flows during the filling process. However, there is a limitation on the number and size of openings that can be placed in one constrained area.

If the openings are spaced too close to one another, the liquid may join together to form one stream, which in turn, can result in the same aforementioned stringing and/or splashing problems. If the openings are spaced too far apart, fewer openings will be able to fit on the nozzle surface resulting in reduced volumetric flow rate and slower filling speed. Stringing and splashing can waste liquid, contaminate the outer surface of the container and/or contaminate the filling equipment itself. Having a nozzle with too large an opening or a nozzle with openings spaced too closely to one another may result in an increase in the velocity of the liquid. An increase in the velocity of the liquid stream may result in greater entrapment of air which in turn causes undesirable foaming of the liquid near the impinging jet when the liquid hits the bottom surface of the container. In order to mitigate or avoid splash-back and air entrapment, manufacturers can use oversized containers to provide enough head space to prevent any back-splash from exiting the container. This creates waste in terms of the amount of material used to make the containers, which can be costly, and can result in containers that appears to be less than completely filled. Manufacturers also slow the filling line rate down to compensate for splash-back and for air entrapment which may result in a decrease in number of containers that can be filled on a single filling line during a given time.

In view of the above, there is a continuing unaddressed need for nozzles for filling machines that are capable of quickly filling a succession of containers with liquid by increasing the volumetric flow rate of the liquid while lessening or avoiding splashing, stringing, dripping, and foaming of the liquid, and that are capable of cleanly shutting off the flow of liquid between containers to avoid dripping of the liquid outside of the containers at the end of a filling event.

SUMMARY OF THE INVENTION

A multi-hole nozzle component comprising: a periphery, an inlet side having an inlet surface, and an opposing outlet side having an outlet surface, wherein the nozzle component has a longitudinal axis extending from the inlet side to the outlet side; a plurality of first passageways extending through the nozzle component from the inlet side to the outlet side, wherein the plurality of first passageways form a plurality of first openings at the outlet surface, wherein the plurality of first openings are arranged about the longitudinal axis of the nozzle component, wherein each of the first openings has a first opening area; a plurality of second passageways extending through the nozzle component from the inlet side to the outlet side, wherein the plurality of second passageways form a plurality of second openings at the outlet surface, wherein the plurality of second openings are arranged about the plurality of first openings, wherein each of the second openings has a second opening area, wherein the second opening area is greater than the first opening area; and a plurality of third passageways extending through the nozzle component from the inlet side to the outlet side, wherein the plurality of third passageways form a plurality of third openings at the outlet surface, wherein the plurality of third openings are arranged about the plurality of second openings, wherein each of the third openings has a third opening area, wherein the third opening area is about equal to the second opening area.

DETAILED DESCRIPTION

Nozzle Assembly

Figure 1:
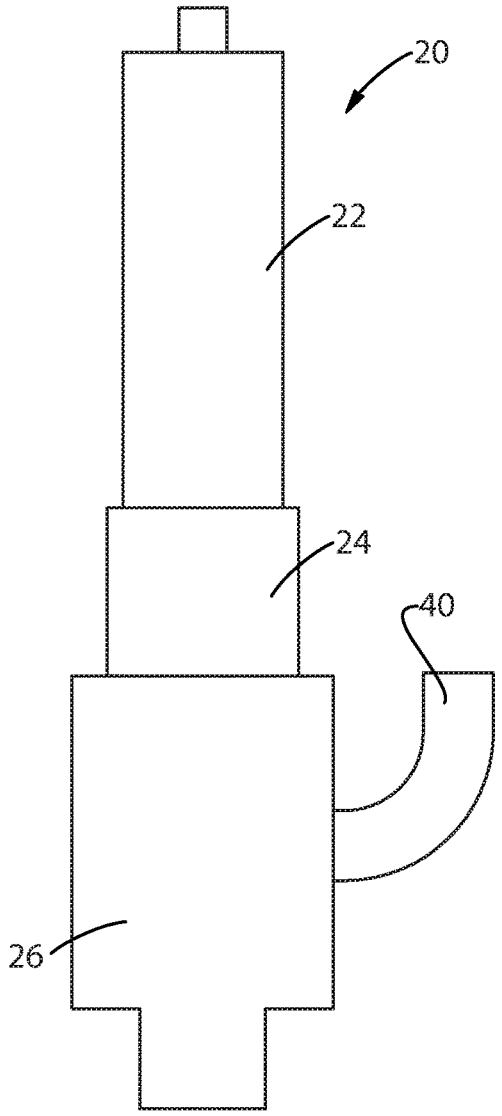
FIG. 1 is a schematic side view of a filling nozzle.
Figure 2:
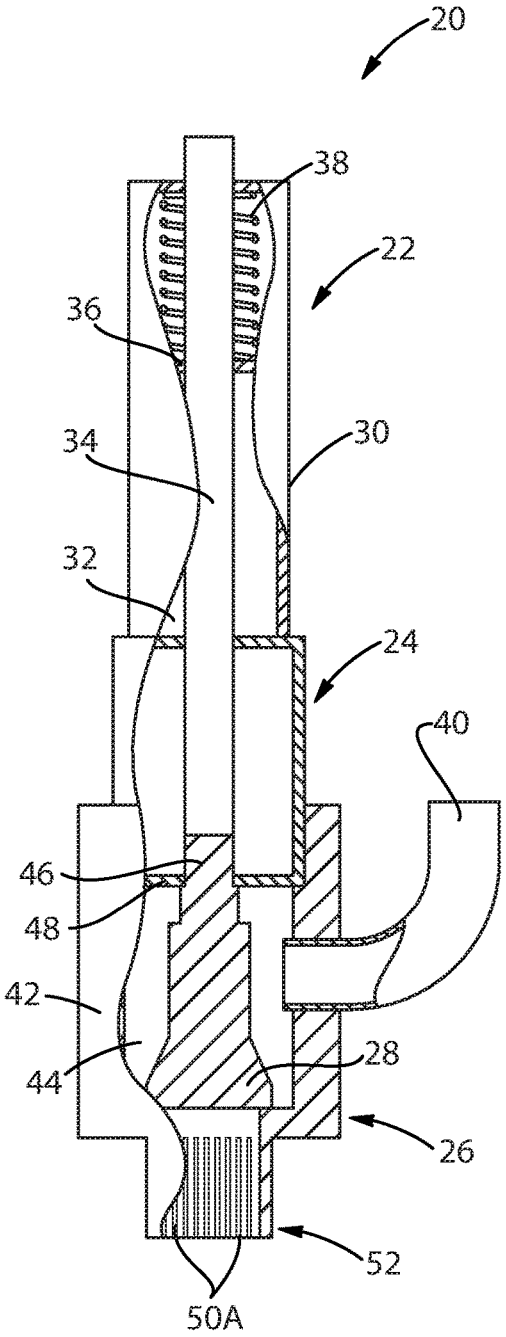
FIG. 2 is a partial cut view to show internal detail with a further partial cross-sectional view of the filling nozzle shown in FIG. 1.

FIGS. 1 and 2 show a non-limiting example of a multi-hole nozzle assembly 20. FIG. 2 shows that the multi-hole nozzle assembly 20 may generally comprise an air cylinder 22, an optional connecting body 24, and a nozzle body 26. The air cylinder 22 may move the stopper 28 inside the nozzle body 26 to open and close a multi-hole nozzle component 52. The optional connecting body 24 may connect the air cylinder 22 to the nozzle body 26.

The air cylinder 22 may comprise an air cylinder housing 30 having an interior hollow space 32 therein. The air cylinder 22 further comprises an air cylinder rod 34, a piston 36, and a spring 38. In its usual orientation, during operation, the air cylinder 22 will move the air cylinder rod 34 upward in order to open the nozzle component 52, and downward to close the nozzle component 52. The spring 38 may hold the stopper 28 against the openings in the nozzle body 26 and may keep liquid from running out of the nozzle component 52 in the event air pressure to the filling machine is turned off, for instance for an emergency, maintenance, air tubing failure, or any other such event. The air cylinder 22 may comprise any suitable commercially available air cylinder. The optional connecting body 24 may comprise an element of any configuration that is suitable for connecting the air cylinder 22 to the nozzle body 26.

The nozzle body 26 may be joined to the other portion(s) of the nozzle assembly 20, and may form the outlet of the nozzle assembly 20. The nozzle body 26 may comprise a nozzle body housing 42 and may have at least one inlet conduit 40 joined thereto so that it is in fluid communication with the inner chamber 44 of the nozzle body 26. The nozzle assembly 20 may further comprise an optional stem 46 that may be joined to the air cylinder rod 34. A flexible diaphragm 48 may encircle at least a portion of the length of the air cylinder rod 34 or stem 46.

The nozzle body 26 may have a plurality of spaced passageways 50 that pass through the nozzle body 26. The passageways 50 may be integrally formed in a portion of the nozzle body 26 itself, such as the nozzle body housing 42, or the passageways 50 may be formed in a separate nozzle component 52, such as an insert or an attachment, that is joined to the remainder of the nozzle body 26. For example, such a separate nozzle component 52 may be removably affixed, such as by a clamp, to the nozzle body housing 42. The term nozzle component 52 will be used herein to describe either of the following nozzle constructions: the portion of the nozzle body 26 that has the passageways 50 formed therein; or a separate nozzle piece that has the passageways 50 formed therein. The nozzle body 26 may have a stopper 28 therein at the end of the air cylinder rod 34 or optional stem 46 for closing the passageways 50 and shutting off the nozzle component 52.

The multi-hole nozzle assembly 20 may function as follows. The liquid to be filled into containers is delivered under pressure to the nozzle inlet 40. The air cylinder rod 34 is in the closed position. In this position, the liquid is contained inside the inner chamber 44 of the nozzle body 26. After a container is in position to be filled, a machine program sends a signal to a conventional solenoid valve that shifts and sends air pressure to the air cylinder 22. The air cylinder rod 34 moves upward allowing the liquid to flow through the passageways 50 into the bottle. When the program detects that the correct amount of liquid has been delivered to the container, a signal is sent to the valve that shifts and moves the air cylinder rod 34 downward closing off the passageways 50 and preventing any additional liquid from flowing out of the nozzle component 52. The liquid may be any liquid.

Multi-Hole Nozzle Component

Figure 3:
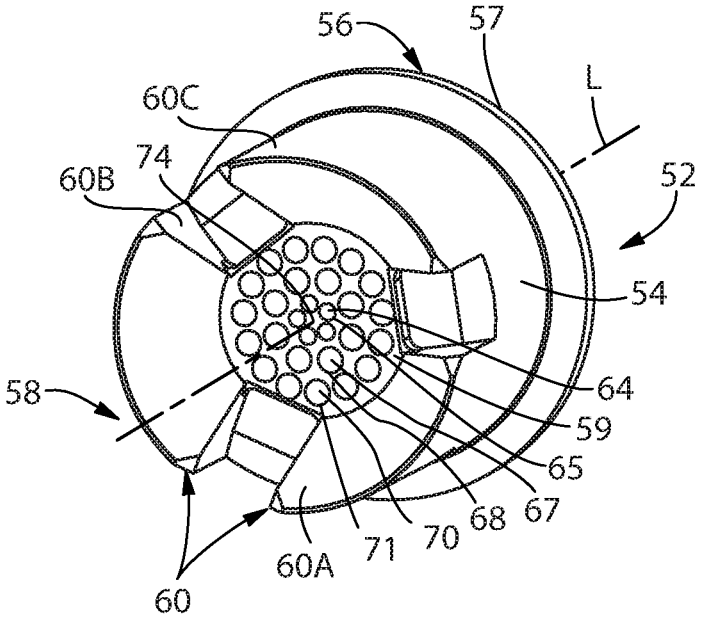
FIG. 3 is a perspective view of a nozzle component having centering elements thereon for centering the nozzle component on the outside of the neck of a bottle.

FIG. 3 shows a multi-hole nozzle component 52 in the form of a nozzle piece. The multi-hole nozzle component 52 may have a nozzle component periphery 54, an inlet side 56 having an inlet surface 57, and an opposing outlet side 58 having an outlet surface 59. The multi-hole nozzle component 52 may have a longitudinal axis L extending from the inlet side 56 to the outlet side 58.

The multi-hole nozzle component 52 may have a plurality of first passageways 64 extending through the multi-hole nozzle component 52 from the inlet side 56 to the outlet side 58, in order to provide passageways for liquid to flow therethrough. The plurality of first passageways 64 may form a plurality of first openings 65 at the outlet surface 59. The plurality of first openings 65 may be where liquid ultimately exits the nozzle component 52. The plurality of first openings 65 may be arranged about or arranged around the longitudinal axis L. Each first opening 65 has a first opening 65 area.

The multi-hole nozzle component 52 may have a plurality of second passageways 67 extending through the multi-hole nozzle component 52 from the inlet side 56 to the outlet side 58, in order to provide passageways for liquid to flow therethrough. The plurality of second passageways 67 may form a plurality of second openings 68 at the outlet surface 59. The plurality of second openings 68 may be where liquid ultimately exits the nozzle component 52. The plurality of second openings 68 may be arranged about or arranged around the plurality of first openings 65. Each second opening 68 has a second opening 68 area. The second opening 68 area may be greater than the first opening 65 area.

The multi-hole nozzle component 52 may have a plurality of third passageways 70 extending through the multi-hole nozzle component 52 from the inlet side 56 to the outlet side 58, in order to provide passageways for liquid to flow therethrough. The plurality of third passageways 70 may form a plurality of third openings 71 at the outlet surface 59. The plurality of third openings 71 may be where liquid ultimately exits the nozzle component 52. The plurality of third openings 71 may be arranged about or arranged around the plurality of second openings 68. Each third opening 71 has a third opening 71 area. The third opening 71 area may be about equal to the second opening 68 area. The third opening 71 area may be greater than the second opening 68 area.

Figure 4:
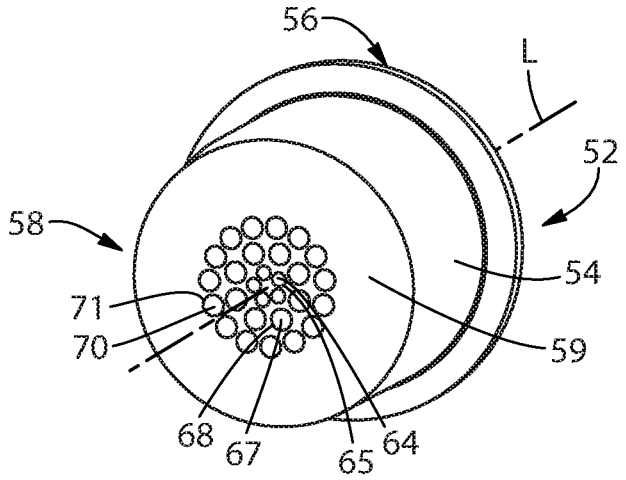
FIG. 4 is a perspective view of the outlet surface of a nozzle component without the centering elements thereon.
Figure 5:
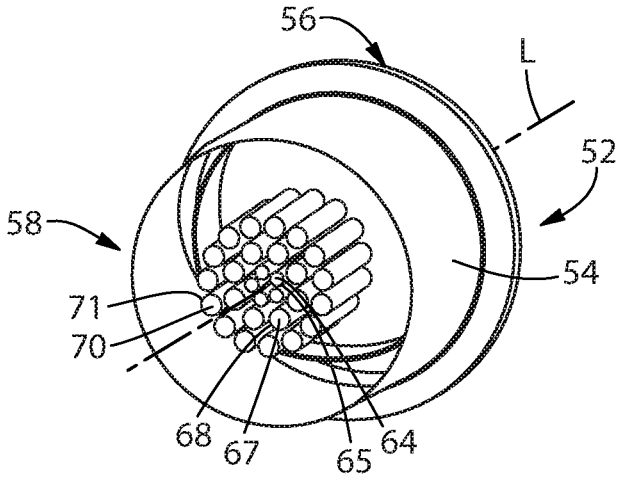
FIG. 5 is a cross-sectional perspective view of a nozzle component without the centering elements thereon.
Figure 6:
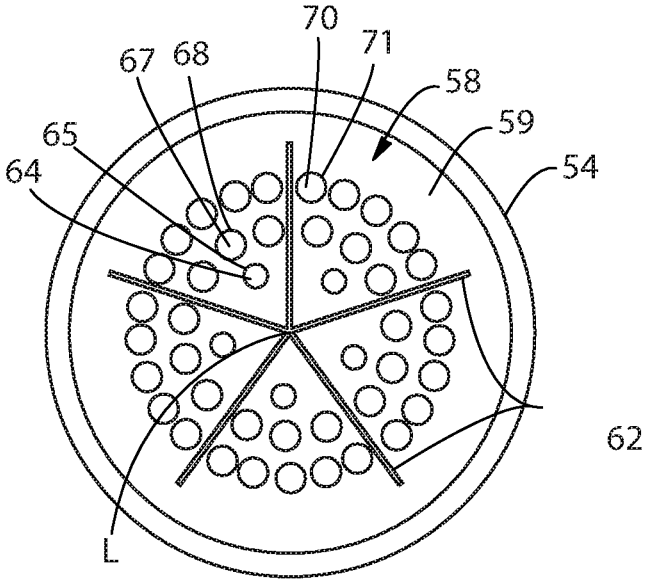
FIG. 6 is a plan view of a nozzle component having grooves.
Figure 7:
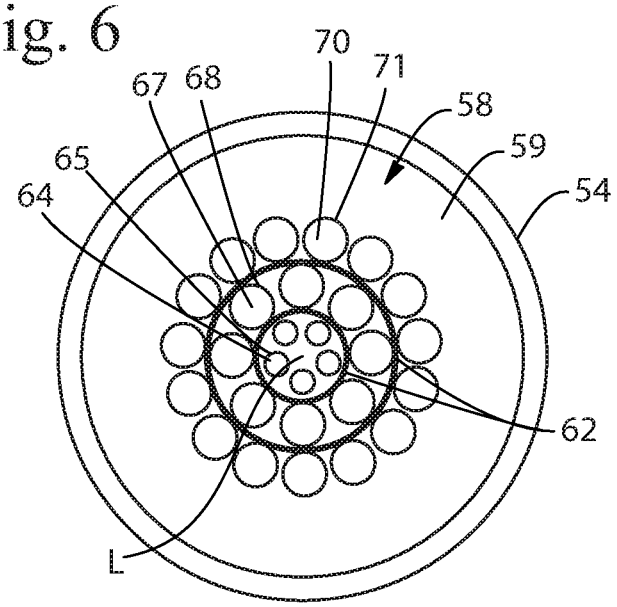
FIG. 7 is a plan view of a nozzle component having grooves.
Figure 8:
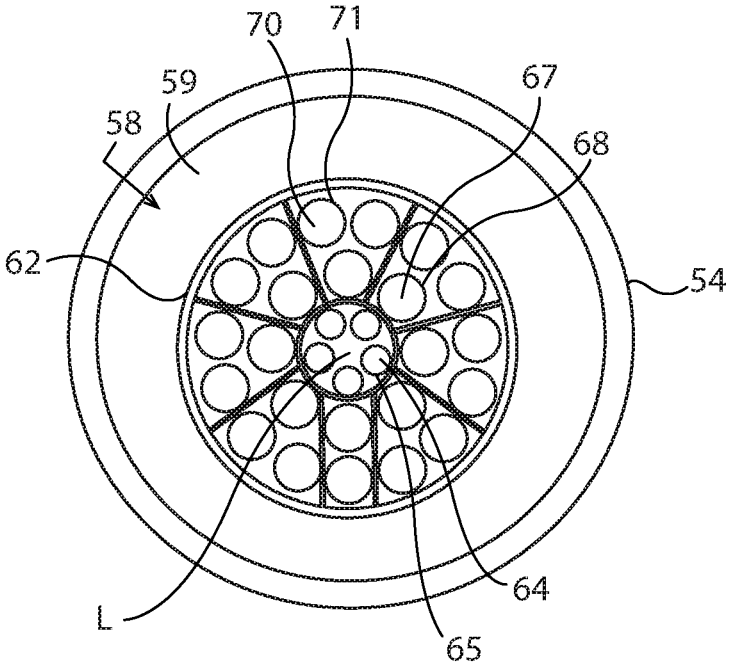
FIG. 8 is a plan view of a nozzle component having grooves.
Figure 9:
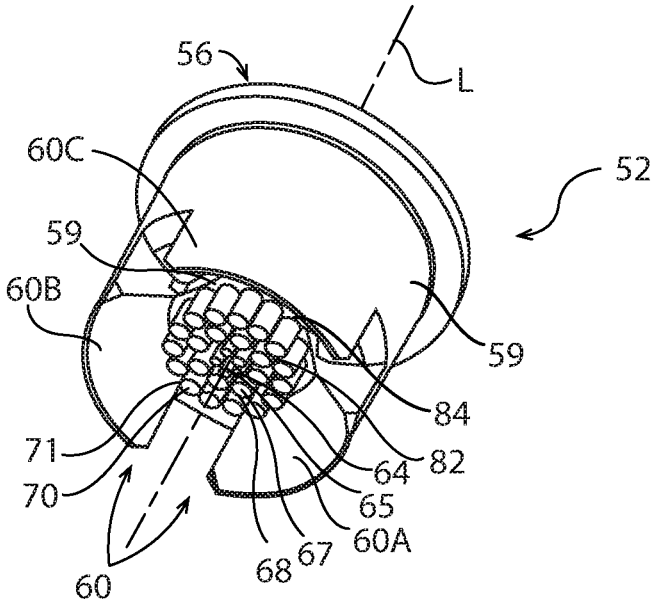
FIG. 9 is a perspective view of a nozzle component wherein each distal end of each passageway projects beyond the outlet surface by the same predetermined magnitude of projection.
Figure 10:
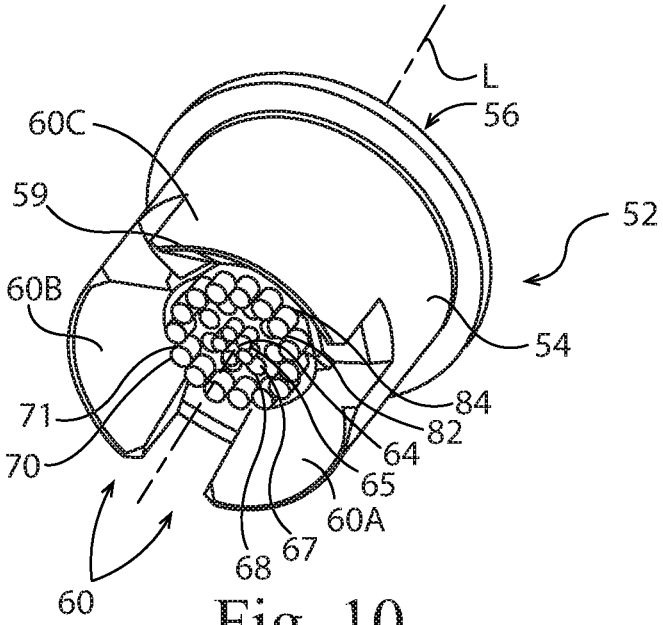
FIG. 10 is a perspective view of a nozzle component wherein each distal end of each passageway projects beyond the outlet surface by varying predetermined magnitudes of projection.

FIGS. 3-10 show different multi-hole nozzle component 52 embodiments. FIG. 3 shows a perspective view of a nozzle component 52 having centering elements 60A-60C thereon. FIG. 4 shows a perspective view of the outlet surface 59 of the nozzle component 52 without the centering elements 60A-60C thereon. FIG. 5 shows a cross-sectional perspective view of a nozzle component 52 without the centering elements 60A-60C thereon. FIG. 6 shows a nozzle component 52 having a plurality of grooves 62 in a substantially linear arrangement in the plan view. FIG. 7 shows a nozzle component 52 having a plurality grooves 62 in a substantially circular arrangement in the plan view. FIG. 8 shows a nozzle component 52 having a plurality of grooves 62 arranged about the openings. FIG. 9 shows a nozzle component 52 wherein each distal end 82 of each passageway projects beyond the outlet surface 59 by the same predetermined magnitude of projection. FIG. 10 shows a nozzle component 52 wherein each distal end 82 of each passageway projects beyond the outlet surface 59 by varying, or non-uniform, predetermined magnitudes of projection.

As shown in FIGS. 3-10, the multi-hole nozzle component 52 may have a longitudinal axis L extending from the inlet side 56 to the outlet side 58. The multi-hole nozzle component 52 may have a centroid 74. The centroid 74 is the center of mass of the nozzle component 52. The longitudinal axis L may pass through the centroid 74.

Each of the first openings 65, each of the second openings 68, and each of the third openings 71 may be sized and configured so that when liquid is dispensed through the nozzle component 52, the liquid exits the outlet side 58 in the form of separate streams from each opening.

The plurality of first openings 65, the plurality of second openings 68, and the plurality of third openings 71 may be concentric about the longitudinal axis L. The term concentric is used herein to denote circles, arcs, or other shapes that share the same center. The plurality of first openings 65 may be arranged concentrically about the longitudinal axis L. The plurality of second openings 68 may be arranged concentrically about the plurality of first openings 65. The plurality of third openings 71 may be arranged concentrically about the plurality of second openings 68. The plurality of first openings 65, plurality of second openings 68, and the plurality of third openings 71 may be arranged about or arranged around the same center, the longitudinal axis L. Arranged around may encompass a substantially circular arrangement, not limited to a full circle. A concentric arrangement may provide the benefit of centering the liquid stream when the nozzle component 52 is placed above or within the top opening of the container. A concentric arrangement may provide the benefit of balancing the nozzle component 52. A concentric arrangement may provide the benefit of the liquid streams being less likely to come into contact with the sides of the container which could lead to uneven flow. The multi-hole nozzle component 52 may have at least three pluralities of openings. The multi-hole nozzle component 52 may have at least three pluralities of openings arranged concentrically about the longitudinal axis L.

The plurality of first openings 65, the plurality of second openings 68, and the plurality of third openings 71 may be substantially circular, as shown in FIG. 3. The arrangement of the plurality of first openings 65 may be substantially circular. The arrangement of the plurality of second openings 68 may be substantially circular. The arrangement of the plurality of third openings 65 may be substantially circular. A circular arrangement may provide the benefit of more accurate positioning when placed on a container with a circular neck. A circular arrangement may provide the benefit of filling a container properly with less to no splashing, dripping, or stringing even where the outer rim of the container neck is between about 1 mm and about 1.25 mm in close edge to close edge distance from the outermost openings. A circular arrangement may also provide the benefit of being able to place a greater number of openings in a finite space with enough room in between each opening so that the liquid streams do not converge and are maintained as separate streams from each opening. Having a greater number of openings for liquid to flow through may provide the benefit of increasing the volumetric flow rate, or the volume of liquid which passes through the openings into the container per unit time, while decreasing the velocity of the liquid. However, one of skill in the art will recognize that the arrangement of each plurality of openings is not so limited. Other suitable spatial arrangements for each plurality of openings may include but is not so limited to substantially triangular and substantially rectangular. The arrangement of each plurality of openings may be any suitable spatial arrangement that would provide the benefit that when liquid is dispensed through the nozzle component 52, the liquid exits the outlet side 58 in the form of separate streams from each opening.

The first passageways 64, second passageways 67 and third passageways 70 extending through the nozzle component 52 may be substantially parallel to each other and may also be parallel to the longitudinal axis of the nozzle component 52. The passageways being generally parallel to each other may provide the benefit of allowing for the liquid to move in a substantially linear motion for faster delivery through the passageways and the passageways to not cross each other.

As shown in FIGS. 3-10, the plurality of first openings 65 may have fewer openings than the plurality of second openings 68. When the plurality of second openings 68 is arranged about or arranged around the plurality of first openings 65 and the plurality of second openings 68 is closer to the nozzle component periphery 54 than the plurality of first openings 65 is to the nozzle component periphery 54 and the plurality of first openings 65 is closer to the centroid 74 than the plurality of second openings 68 is to the centroid 74, having more openings in the plurality of second openings 68 may provide the benefit of increasing the volumetric flow rate by providing a greater number of openings in a finite space, providing more of a combined opening area of all openings for liquid to flow through and leaving enough space in between the openings for the liquid to exit the outlet side 58 in the form of separate streams from each opening.

As shown in FIGS. 3-10, the plurality of second openings 68 may have fewer openings than the plurality of third openings 71. When the plurality of third openings 71 is arranged about or arranged around the plurality of second openings 68 and the plurality of third openings 71 is closer to the nozzle component periphery 54 than the plurality of second openings 68 is to the nozzle component periphery 54 and the plurality of second openings 68 is closer to the centroid 74 than the plurality of third openings 71 is to the centroid 74, having more openings in the plurality of third openings 71 may provide the benefit of increasing the volumetric flow rate by providing a greater number of openings in a finite space, providing more of a combined opening area of all openings for liquid to flow through and leaving enough space in between the openings for the liquid to exit the outlet side 58 in the form of separate streams from each opening.

The first passageways 64, second passageways 67, and third passageways 70 may be sized so that when liquid is dispensed through the nozzle component 52, the liquid exits the outlet side 58 in the form of separate streams from each opening. Each of the individual passageways has a cross-section. Each individual passageway of the plurality of first passageways 64 may have the same cross-sectional size and configuration. Each individual passageway of the plurality of second passageways 67 may have the same cross-sectional size and configuration. Each individual passageway of the plurality of third passageways 70 may have the same cross-sectional size and configuration. Each individual passageway of the plurality of second passageways 67 and each individual passageway of the plurality of third passageways 70 may have the same cross-sectional size and configuration. The inner diameter of each passageway may stay the same throughout the length of the passageway. The inner diameter of each passageway may vary throughout the length of the passageway. The inner diameter of each individual passageway of the plurality of first passageways 64 may be about 2 mm. The inner diameter of each individual passageway of the plurality of second passageways 67 may be about 3 mm. The inner diameter of each individual passageway of the plurality of third passageways 70 may be about 3 mm. The plurality of first passageways 64, plurality of second passageways 67 and/or the plurality of third passageways 70 may have substantially circular cross-sections.

The first openings 65, the second openings 68, and the third openings 71 may be sized so that when liquid is dispensed through the nozzle component 52, the liquid exits the outlet side 58 in the form of separate streams from each opening.

The first opening 65 area, second opening 68 area, and third opening 71 area is each a measurement of the cross-sectional area of the respective opening measured at the opening at the distal end 82. As shown in FIGS. 3-10, each first opening 65, each second opening 68, and each third opening 71 may each have a substantially circular cross-section. However, one of skill in the art will recognize that the shape of the cross-section is not so limited. Other suitable cross-section shapes may include but are not limited to ellipses, rectangles, triangles, and horseshoes.

Each first opening 65 may have a first opening 65 diameter measured at the inner surface of the opening. Each second opening 68 may have a second opening 68 diameter measured at the inner surface of the opening. Each third opening 71 may have a third opening 71 diameter measured at the inner surface of the opening. The third opening 71 diameter may be about equal to the second opening 68 diameter. The third opening 71 diameter may be greater than the second opening 68 diameter.

The first opening 65 diameter may be about 2 mm. The second opening 68 diameter may be about 3 mm. The third opening 71 diameter may be about 3 mm. The first opening 65 diameter to the second opening 68 diameter may have a ratio of about 2:3. The second opening 68 diameter to the third opening 71 diameter may have a ratio of about 1:1. The first opening 65 diameter to the third opening 71 diameter may have a ratio of about 2:3. The first opening 65 diameter to the second opening 68 diameter to the third opening 71 diameter may have a ratio of about 2:3:3. Without being bound by theory, a first opening 65 diameter to second opening 68 diameter ratio of about 2:3 may provide the benefit of less foaming given the lower surface tension each droplet of liquid forms. Without being bound by theory, a first opening 65 diameter to second opening 68 diameter ratio of about 2:3 may provide a benefit of less splashing and less dripping contamination given the lower surface tension each droplet of liquid forms. Alternatively, the first opening 65 diameter may be about 2.5 mm. The second opening 68 diameter may be about 3.5 mm. The first opening 65 diameter to the second opening 68 diameter may have a ratio of between about 2:3 and about 2.5:3.5.

The plurality of first openings 65 may comprise about five or more first openings 65, the plurality of second openings 68 may comprise about ten or more second openings 68, and the plurality of third openings 71 may comprise about fifteen or more third openings 71.

As shown in FIGS. 6-8, the outlet surface 59 of the nozzle component 52 may have a plurality of grooves 62 therein that are disposed to run among the first openings 65, second openings 68, and third openings 71.

The grooves 62 may each be sized and configured to reduce dripping of liquid after the nozzle component 52 is closed by separating the first openings 65, second openings 68, and third openings 71 at the outlet surface 59 such that any individual meniscus formed at the first openings 65, second openings 68, and third openings 71 at the outlet surface 59 of the nozzle component 52 cannot combine to produce a large drop. The grooves 62 in the outlet surface 59 of the nozzle component 52 may each be of any suitable configuration and be arranged in any suitable pattern to keep the aforementioned individual menisci from combining to produce a large drop. The grooves 62 may be substantially rectilinear, curvilinear, rectangular, rounded, oval, v-shaped or combinations thereof at the cross section. Grooves 62 that are substantially rectangular at the cross section may provide the benefit of having a sharp edge at the top portion of the groove 62 where the groove 62 meets the outer surface 59 that may keep liquid from being pulled into the groove 62.

The grooves 62 may, thus, at least partially surround the openings to separate the openings. The number of openings that are separated from each other by the grooves 62 can range from two to more, depending on characteristics, such as viscosity, of the liquid being dispensed, as shown in FIGS. 6-8. The number of openings that are separated from each other by the grooves 62 can range from three to more, depending on characteristics, such as viscosity, of the liquid being dispensed, as shown in FIGS. 6-8. The number of openings that are separated from each other by the grooves 62 can range from five to more, depending on characteristics, such as viscosity, of the liquid being dispensed, as shown in FIGS. 6-7. Keeping the individual menisci from combining to produce a large drop may provide the benefit of preventing stringing, preventing dripping on machinery and on the container, which in turn may also provide the benefit of preventing label adhesion issues which can occur when liquid drips onto the container. While it is possible to separate openings by distances that are large enough to avoid any individual liquid menisci formed at the openings on the outlet surface 59 of the nozzle component 52 from combining to produce a large drop, the grooves 62 permit the openings and thus each opening's respective passageway to be located closer to each other without this occurring. The edges of the grooves 62 may be adjacent to the openings. The edges of the grooves 62 may not touch the openings.

As shown in FIG. 6, the surface of the outlet side 58 of the nozzle component 52 may have a plurality of grooves 62 therein that are disposed to run among the run among the first openings 65, second openings 68, and third openings 71 where the grooves 62 may separate one or more first openings 65 from each other, one or more second openings 68 from each other, and/or one or more third openings 71 from each other. The grooves 62 may extend radially outward from the longitudinal axis L towards the nozzle component periphery 54 of the nozzle component 52. The grooves 62 may intersect with each other at the longitudinal axis L. The grooves 62 may not intersect with each other at the longitudinal axis L. Some of the grooves 62 may intersect with each other at the longitudinal axis L and some of the grooves may not intersect with each other at the longitudinal axis L. The grooves 62 may, but need not, extend all the way to the nozzle component periphery 54 of the nozzle component 52. In FIG. 6, the grooves 62 separate the openings into groups of six openings wherein the six openings may comprise one first opening 65, two second openings 68, and three third openings 71. The first openings 65 may be about 2 mm in diameter and the second openings 68 and the third openings 71 may be about 3 mm in diameter. The openings may be spaced apart by a distance of between about 0.35 mm and about 4.5 mm measured close edge to close edge. The grooves 62 may have a width of between about 2 mm and about 4 mm and a depth of at least about 1 mm measured at the cross section.

As shown in FIG. 7, the surface of the outlet side 58 of the nozzle component 52 may have a plurality of grooves 62 therein that are disposed to run among the plurality of first openings 65, the plurality of second openings 68, and the plurality of third openings 71, separating each plurality of openings. The grooves 62 may at least partially surround the plurality of first openings 65, the plurality of second openings 68, and the plurality of third openings 71 to separate the plurality of first openings 65, the plurality of second openings 68, and the plurality of third openings 71 from each other. The arrangement of each groove 62 may be substantially circular in the plan view. In FIG. 7, the grooves 62 separate the openings into a plurality of first openings 65, a plurality of second openings 68, and a plurality of third openings 71. The plurality of first openings 65 may comprise about five or more first openings 65, the plurality of second openings 68 may comprise about ten or more second openings 68, and the plurality of third openings 71 may comprise about fifteen or more third openings 71. The first openings 65 may be about 2 mm in diameter and the second openings 68 and the third openings 71 may be about 3 mm in diameter. The openings may be spaced apart by a distance of 3.4 mm measured close edge to close edge. The grooves 62 may be about 2 to about 4 mm in width and a depth of about 2 mm measured at the cross section.

Figure 12:
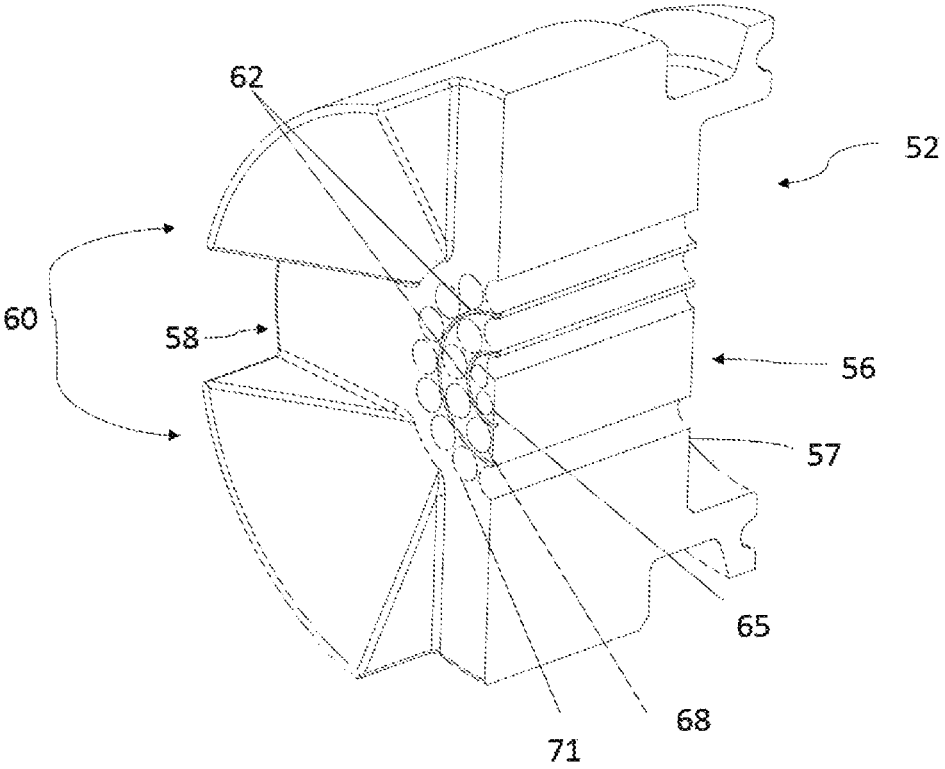
FIG. 12 is a cross-sectional perspective view of the nozzle component having grooves and centering elements thereon.

The grooves 62 may have a width and a depth as illustrated in FIG. 12. The depth of the grooves 62 may be formed into the surface of the outlet side 58 such as to form a recess.

As shown in FIG. 8, the surface of the outlet side 58 of the nozzle component 52 may have a plurality of grooves 62 therein that are disposed to run among one or more of the first openings 65, one or more of the second openings 68, and one or more of the third openings 71. The grooves 62 may at least partially surround one or more first openings 65, and or one or more second openings 68, and or one or more third openings 71. In FIG. 8, the grooves 62 separate the plurality of first openings 65 from the second openings 68 and the third openings 71. In FIG. 8, the grooves 62 separate the openings into groups of two or three openings wherein the two or three openings may comprise at least one second opening 68 and one or more third openings 71. The first openings 65 may be about 2 mm in diameter and the second openings 68 and the third openings 71 may be about 3 mm in diameter. The openings may be spaced apart by a distance of between about 0.35 mm and about 4.5 mm measured close edge to close edge. The grooves 62 may have a width of between about 2 mm and about 4 mm and a depth of at least about 1 mm measured at the cross section.

The arrangements of the plurality of grooves 62 as shown in FIGS. 6-8 are meant to be non-limiting. FIGS. 6-8 show that the grooves 62 that divide the openings and/or divide the plurality of openings can be arranged in many different patterns.

Passageways of Predetermined Magnitudes of Projection

As shown in FIGS. 9 and 10, each of the first passageways 64, each of the second passageways 67 and/or each of the third passageways 70 may have a distal end 82 and an opposing proximal end 84. The proximal end 84 of each passageway is attached to the outlet surface 59. The distal end 82 of each passageway may project beyond the outlet surface 59 by a predetermined magnitude, or length, of projection. As shown in FIG. 9, each distal end 82 of each of the plurality of first passageways 64, the plurality of second passageways 67, and the plurality of third passageways 70 may project beyond the outlet surface 59 by the same predetermined magnitude of projection. Having a void space between each opening rather than having the outlet surface 59 between each opening may provide the benefit that any individual meniscus formed at the first openings 65, second openings 68, and third openings 71 at the outlet surface 59 of the nozzle component 52 cannot combine to produce a large drop. Keeping the individual menisci from combining to produce a large drop may provide the benefit of preventing stringing and preventing dripping and may also provide the benefit of preventing the decrease of the volumetric flow rate. As shown in FIG. 10, each distal end 82 of each of the plurality of first passageways 64, the plurality of second passageways 67, and the plurality of third passageways 70 may project beyond the outlet surface 59 by varying, or non-uniform, predetermined magnitudes of projection. Having the distal ends 82 of each plurality of passageways at varying, or non-uniform, predetermined magnitudes of projection may provide the benefit of a greater void space between each opening which in turn may provide the benefit that any individual meniscus formed at the first opening 65, second openings 68, and third openings 71 at the outlet surface 59 cannot combine to produce a large drop and may further provide the benefit of easier fabrication of the nozzle component 52 by providing more space for a drill bit to drill around. Each distal end 82 of each of the of the first passageways 64, each of the second passageways 67, and each of the third passageways 70 may project beyond the outlet surface 59 by varying, or non-uniform, predetermined magnitudes of projection. The inner diameter of each passageway may stay the same throughout the length of the passageway. The inner diameter of each passageway may vary throughout the length of the passageway.

The predetermined magnitude or magnitudes of projection can range from about 1 mm to about 6 mm, depending on characteristics of the liquid such as the liquid's viscosity and on characteristics of the container the liquid is being dispensed into such as the size and depth of the container neck, and also depending on the dispensing rate.

Centering Feature

As shown in FIGS. 3, 9, and 10, the multi-hole nozzle component 52 may have a centering feature 60 that extends outwardly from the outlet side 58. The centering feature 60 is used to align the nozzle component 52 with the neck of the container to be filled. The centering feature 60 may be placed adjacent to the neck of the container. The centering feature 60 may be placed above the neck of the container. The centering feature 60 may encircle the neck of the container. The centering feature 60 may be joined to the neck of the container in any way suitable to for liquid to flow into the container. Having a centering feature 60 aligning the nozzle component 52 with the neck of the container during linear filling or rotary filling may provide the additional benefit of the bottom of the container being accurately positioned as well as the benefit of the container not having to be supported during filling. The centering feature 60 may have several spaced apart centering elements 60A-60C that comprise extensions of the nozzle component periphery 54 of the nozzle component 52. The centering elements 60A-60C have inner surfaces that are tapered so that they are wider at their base (or "proximal ends") and narrower at their distal ends.

Stopper

Figure 11:
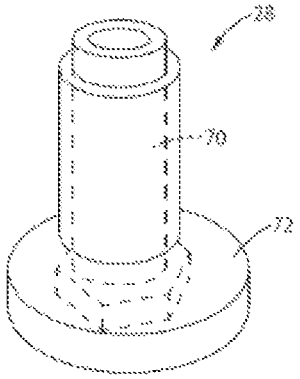
FIG. 11 is a perspective view of a stopper for the filling nozzle.

FIG. 11 shows one embodiment of a stopper 28 for the nozzle assembly 20. The stopper 28 may be of any suitable configuration, and may be made of any suitable material(s). In the embodiment shown, the stopper 28 is configured to have a substantially flat free end that is large enough to simultaneously cover all of the openings formed by the passageways in the inlet side 56 of the nozzle body 26. The stopper 28 may be made of a single material, such as stainless steel. As shown in FIG. 11, the stopper 28 may comprise a metal insert 70 and a compressible material 72 at least at the end thereof for shutting off the nozzle component 52. As shown in FIGS. 2 and 11, the compressible material 72 may encase the metal insert 70.

The components of the multi-hole nozzle assembly 20 may be made in any suitable manner from any suitable materials. The various components (other than any compressible material used for the stopper) can be machined or cast from metal, such as stainless steel, or from plastic, or certain components may be made out of metal, and certain components may be made out of plastic.

Process

In some aspects, the present disclosure relates to a process of dispensing liquid. The process may comprise the steps of: providing a low viscosity liquid hard surface cleaner, providing a container, and filling the container with a multi-hole nozzle component 52.

Combinations:

A. A multi-hole nozzle component 52 comprising:

a periphery 54, an inlet side 56 having an inlet surface 57, an outlet side 58 opposing said inlet side having an outlet surface 59, a longitudinal axis L extending from said inlet side to said outlet side;

a plurality of first passageways 64 extending through said nozzle component from said inlet side to said outlet side, wherein said plurality of first passageways form a plurality of first openings 65 at said outlet surface, wherein said plurality of first openings are arranged about said longitudinal axis of said nozzle component, wherein each of said first openings has a first opening 65 area;

a plurality of second passageways 67 extending through said nozzle component from said inlet side to said outlet side, wherein said plurality of second passageways form a plurality of second openings 68 at said outlet surface, wherein said plurality of second openings are arranged about said plurality of first openings, wherein each of said second openings has a second opening area, wherein said second opening area is greater than said first opening 65 area; and a plurality of third passageways 70 extending through said nozzle component from said inlet side to said outlet side, wherein said plurality of third passageways form a plurality of third openings 71 at said outlet surface, wherein said plurality of third openings are arranged about said plurality of second openings, wherein each of said third openings has a third opening area, and wherein said third opening area is equal to said second opening area.

B. The multi-hole nozzle component according to paragraph A, wherein said nozzle component has a centroid 74, and wherein said longitudinal axis passes through said centroid.

C. The multi-hole nozzle component according to any one of paragraphs A or B, wherein said plurality of first openings, said plurality of second openings, and said plurality of third openings are concentric about said longitudinal axis.

D. The multi-hole nozzle component according to any one of paragraphs A to C, wherein said plurality of first openings, said plurality of second openings, and said plurality of third openings are circular.

E. The multi-hole nozzle component according to any one of paragraphs A to D, wherein each of said first openings, each of said second openings, and each of said third openings are sized and configured so that when liquid is dispensed through said nozzle component, the liquid exits the outlet side in the form of separate streams from each opening.

F. The multi-hole nozzle component according to any one of paragraphs A to E, wherein said plurality of first openings has fewer openings than said plurality of second openings and wherein said plurality of second openings has fewer openings than said plurality of third openings.

G. The multi-hole nozzle component according to any one of paragraphs A to F, wherein each of said first openings has a first opening diameter and wherein each of said second openings has a second opening diameter, wherein said first opening diameter to said second opening diameter has a ratio of about 2:3.

H. The multi-hole nozzle component according to any one of paragraphs A to G, wherein said plurality of first passageways, said plurality of second passageways, and said plurality of third passageways extending through said nozzle component are parallel to each other.

I. The multi-hole nozzle component according to any one of paragraphs A to H, wherein said plurality of first passageways, said plurality of second passageways, and said plurality of third passageways have substantially circular cross-sections.

J. The multi-hole nozzle component according to any one of paragraphs A to I, wherein said nozzle component comprises a plurality of grooves 62 in said outlet surface that are disposed to run among said first openings, said second openings, and said third openings, and wherein each of said grooves are sized and configured to reduce dripping of liquid after said nozzle component is closed by separating said first openings, said second openings, and said third openings at said outlet surface such that any individual meniscus formed at said first openings, said second openings, or said third openings at the outlet surface of said nozzle component cannot combine to produce a large drop.

K. The multi-hole nozzle component according to paragraph J, wherein said grooves at least partially surround said plurality of first openings, said plurality of second openings, and said plurality of third openings to separate said plurality of first openings, said plurality of second openings, and said plurality of third openings from each other, and wherein each groove is in a circular arrangement.

L. The multi-hole nozzle component according to any one of paragraphs J or K, wherein said grooves extend radially outward from said longitudinal axis towards said periphery of said nozzle component.

M. The multi-hole nozzle component according to any one of paragraphs A to L, wherein each of said first passageways, said second passageways, and said third passageways has a distal end 82 and an opposing proximal end 84 attached to said outlet surface, wherein each of said distal ends projects beyond said outlet surface.

N. The multi-hole nozzle component according to paragraph M, wherein each of said distal ends of each of said plurality of first passageways, said second passageways, and said third passageways projects beyond said outlet surface by the same magnitude of projection wherein said magnitude of projection is 1 mm, preferably 2 mm, more preferably 3 mm, more preferably 4 mm, more preferably 5 mm, most preferably 6 mm O. The multi-hole nozzle component according to paragraph M, wherein each of said distal ends of each of said plurality of first passageways, said second passageways, and said third passageways projects beyond said outlet surface by varying magnitudes of projection ranging from 1 mm to 6 mm.

As used herein, the term "joined to" encompasses configurations in which an element is directly secured to another element by affixing the element directly to the other element; configurations in which the element is indirectly secured to the other element by affixing the element to intermediate member(s) which in turn are affixed to the other element; and configurations in which one element is integral with another element, i.e., one element is essentially part of the other element. The term "joined to" encompasses configurations in which an element is secured to another element at selected locations, as well as configurations in which an element is completely secured to another element across the entire surface of one of the elements.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multi-hole nozzle component comprising:

a periphery, an inlet side having an inlet surface, an outlet side opposing said inlet side having an outlet surface, a longitudinal axis extending from said inlet side to said outlet side;

a plurality of first passageways extending through said nozzle component from said inlet side to said outlet side, wherein said plurality of first passageways form a plurality of first openings at said outlet surface, wherein said plurality of first openings are arranged about said longitudinal axis of said nozzle component, wherein each of said first openings has a first opening area and a first opening diameter;

a plurality of second passageways extending through said nozzle component from said inlet side to said outlet side, wherein said plurality of second passageways form a plurality of second openings at said outlet surface, wherein said plurality of second openings are arranged about said plurality of first openings, wherein each of said second openings has a second opening area and a second opening diameter, wherein said second opening area is greater than said first opening area; and a plurality of third passageways extending through said nozzle component from said inlet side to said outlet side, wherein said plurality of third passageways form a plurality of third openings at said outlet surface, wherein said plurality of third openings are arranged about said plurality of second openings, wherein each of said third openings has a third opening area and a third opening diameter, and wherein said third opening area is about equal to said second opening area;

wherein said plurality of first openings, said plurality of second openings, and said plurality of third openings are substantially circular;

wherein each of said passageways has a respective inner diameter wherein the inner diameter of each passageway is the same throughout the length of the passageway and wherein the inner diameter of each passageway is the same as the respective first opening diameter, second opening diameter, and third opening diameter of each passageway.

2. The multi-hole nozzle component of claim 1, wherein said nozzle component has a centroid, and wherein said longitudinal axis passes through said centroid.

3. The multi-hole nozzle component of claim 2, wherein said plurality of first openings, said plurality of second openings, and said plurality of third openings are concentric about said longitudinal axis.

4. The multi-hole nozzle component of claim 1, wherein each of said first openings, each of said second openings, and each of said third openings are sized and configured so that when liquid is dispensed through said nozzle component, the liquid exits the outlet side in the form of separate streams from each opening.

5. The multi-hole nozzle component of claim 1, wherein said plurality of first openings has fewer openings than said plurality of second openings.

6. The multi-hole nozzle component of claim 5, wherein said plurality of second openings has fewer openings than said plurality of third openings.

7. The multi-hole nozzle component of claim 1, wherein said first opening diameter to said second opening diameter has a ratio of about 2:3.

8. The multi-hole nozzle component of claim 1, wherein said plurality of first passageways, said plurality of second passageways, and said plurality of third passageways extending through said nozzle component are substantially parallel to each other.

9. The multi-hole nozzle component of claim 1, wherein said plurality of first passageways, said plurality of second passageways, and said plurality of third passageways have substantially circular cross-sections.

10. The multi-hole nozzle component of claim 1, wherein said nozzle component comprises a plurality of grooves in said outlet surface that are disposed to run among said first openings, said second openings, and said third openings, and wherein each of said grooves are sized and configured to reduce dripping of liquid after said nozzle component is closed by separating said first openings, said second openings, and said third openings at said outlet surface such that any individual meniscus formed at said first openings, said second openings, or said third openings at the outlet surface of said nozzle component cannot combine to produce a large drop.

11. The multi-hole nozzle component of claim 10, wherein said grooves at least partially surround said plurality of first openings, said plurality of second openings, and said plurality of third openings to separate said plurality of first openings, said plurality of second openings, and said plurality of third openings from each other, and wherein each groove is in a substantially circular arrangement.

12. The multi-hole nozzle component of claim 10, wherein said grooves extend radially outward from said longitudinal axis towards said periphery of said nozzle component.

13. The multi-hole nozzle component of claim 1, wherein each of said first passageways, said second passageways, and said third passageways has a distal end and an opposing proximal end attached to said outlet surface, wherein each of said distal ends projects beyond said outlet surface by a predetermined magnitude of projection.

14. The multi-hole nozzle component of claim 13, wherein each of said distal ends of each of said plurality of first passageways, said second passageways, and said third passageways projects beyond said outlet surface by the same predetermined magnitude of projection.

15. The multi-hole nozzle component of claim 13, wherein each of said distal ends of each of said plurality of first passageways, said second passageways, and said third passageways projects beyond said outlet surface by varying predetermined magnitudes of projection.

16. The multi-hole nozzle component of claim 1, wherein said nozzle component further comprises a centering feature that extends outwardly from said outlet side.

17. A method of dispensing liquid comprising the steps of providing a low viscosity liquid, providing a container, and filling the container with the multi-hole nozzle component of claim 1.

* * * * *